United States Patent [19]

Puda

[11] Patent Number: 4,531,392

[45] Date of Patent: Jul. 30, 1985

[54] PHASE COMPENSATOR FOR GAUGE CONTROL USING ESTIMATE OF ROLL ECCENTRICITY

[75] Inventor: Mark E. Puda, Churchill Borough, Pa.

[73] Assignee: Aluminum Company of America, Pittsburgh, Pa.

[21] Appl. No.: 591,277

[22] Filed: Mar. 19, 1984

[51] Int. Cl.[3] ..... B21B 37/12

[52] U.S. Cl. ..... 72/10; 72/19

[58] Field of Search ..... 72/10, 19, 20, 8, 11

[56] References Cited

U.S. PATENT DOCUMENTS 3,881,335 5/1975 Cook ..... 72/21

4,222,254 9/1980 King, Jr. et al. ..... 72/8

FOREIGN PATENT DOCUMENTS 192615 11/1983 Japan ..... 72/8

193213 11/1983 Japan ..... 72/10

*Primary Examiner*—Lowell A. Larson

*Assistant Examiner*—Jorji M. Griffin

*Attorney, Agent, or Firm*—Elroy Strickland

[57] ABSTRACT

A method of controlling a rolling mill at high exit strip speed in which eccentricity of one or more of the roll assemblies causes undesired variations in the gauge of material exiting the mill. The method includes storing a model of the response of the load cells that measure the force at which the rolls of the mill engage the material in the mill, and a model of the response of actuator mechanisms of the mill that provide the force. In addition, the frequency of any eccentricity of one or more of the rolls during rotation. This frequency and the stored models are utilized to provide an estimate of possible phase errors caused by the lag in the response of the load cells in measuring the occurrence of cyclic changes in force due to eccentricity of the rolls and by the lag in the response of the actuator mechanism in moving to a particular position upon command from a controller. The estimated phase error is then used to calculate a set of phase compensator gains that operate on the frequency domain representation of the eccentricity estimate in such a manner that when it is transformed to a command signal that is applied to the actuator mechanisms they change position to offset the effects of roll eccentricity on the gauge of the product exiting the mill.

1 Claim, 2 Drawing Figures

PHASE COMPENSATOR FOR GAUGE CONTROL USING ESTIMATE OF ROLL ECCENTRICITY

BACKGROUND OF THE INVENTION

Figure 1:
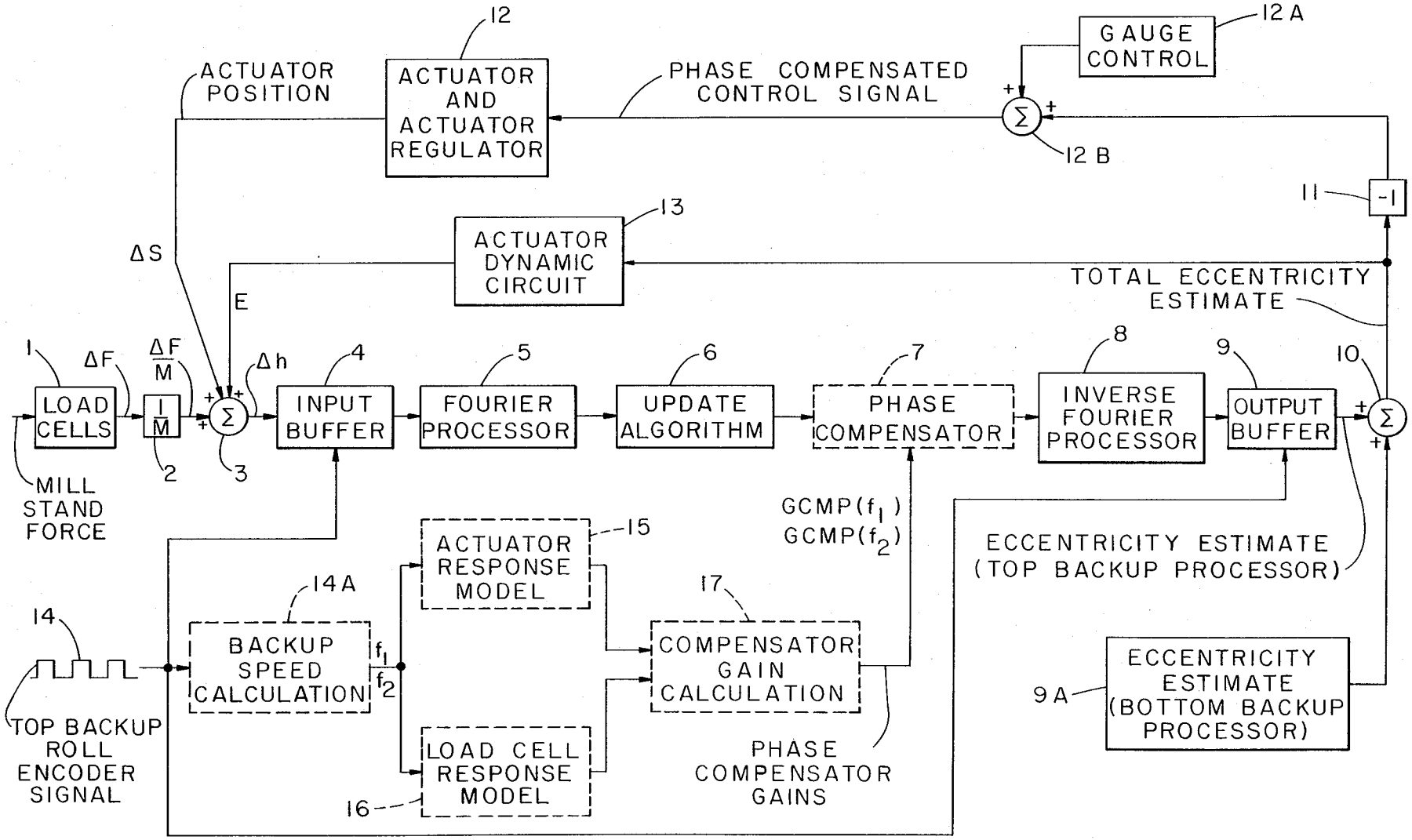

The invention relates generally to an improvement in gauge control in a rolling mill using eccentricity estimates as disclosed in U.S. Pat. No. 4,222,254 to King et al. The disclosure of the patent is incorporated herein by reference.

It has been found that the process described in controlling the gauge of material or product exiting a rolling mill disclosed in the above-mentioned patent is somewhat unstable at travel speeds of the material in excess of about 2,000 feet per minute (fpm). The cause of the problem lies in the inherent lag in the response of transducers or cells in the mill stands that measure the forces or loads at which the material in the mill is rolled, and the inherent lag in the response of actuator mechanisms, such as hydraulic cylinders in the mill stands that mechanically control the loads. At relatively low operating speeds, the frequencies of the eccentricity disturbance are limited to a range of values that allows the force transducers or load cells to provide a measurement signal substantially in phase with the actual force variations occurring in the mill due to this disturbance. Additionally, this range of frequencies is also within a band in which the hydraulic cylinders can respond in phase with control signals in the process of moving the roll assembly of the mill in a manner that offsets the effect of the eccentricity. At higher operating speeds, however, the cells and cylinders cannot respond as fast as the occurrence of the eccentricity disturbance and command signals such that the delay in their response is incorporated in the signals that control the actuator mechanisms (cylinders) of the mill. When this delay becomes too large, the system becomes unstable creating undesired variations in the material leaving the mill. The delay in response is a phase delay of a certain number of degrees on a sign curve representing the eccentricity disturbance, the exact amount of the delay (degrees) depending on the rotational speed of the rolls and the dynamic characteristics of the response of the load cell and actuator mechanisms. The dynamic responses of the load cells and actuators involve both an initial "dead time", in which the load cells and cylinders do not respond at all, and the actual length of time of response of the cells and cylinders after they begin to respond. For example, in one test that led to the subject invention, a 12 millisecond delay (dead time) in the reaction of the mill's hydraulic cylinders, at a backup roll frequency of 3.4 Hz, resulted in a 14.7° phase delay in the control signal generated in the system disclosed in the above-mentioned patent. The total delay in degrees was 65.8.

BRIEF SUMMARY OF THE INVENTION

The present invention cares for the above delay in reaction time of mill actuators and load cells by first measuring the speed of the backup rolls and using the speed measurement to calculate phase error introduced by the load cells and actuators. This is accomplished by first transforming the speed measurement into the frequencies, fundamental and harmonic, of the eccentricity disturbance. These frequencies are then used in conjunction with stored models of the dynamic responses of the load cells and hydraulic cylinders to estimate the gain change and phase error introduced into the system at each frequency of interest. These estimates are converted to a pair of phase compensator gains for each individual frequency. The phase compensator gains are then used to modify the amplitude and more significantly, the phase of the estimated eccentricity calculated by means disclosed in the above-mentioned patent. The modified eccentricity estimate is then used to form a phase corrected command signal employed to offset the effects of roll eccentricity on the gauge of material exiting the mill by ordering appropriate changes in the positions of the actuator mechanisms. Since the delay has been eliminated, the system remains in stable operation resulting in the mill producing a product of constant gauge.

THE DRAWINGS

Figure 2:
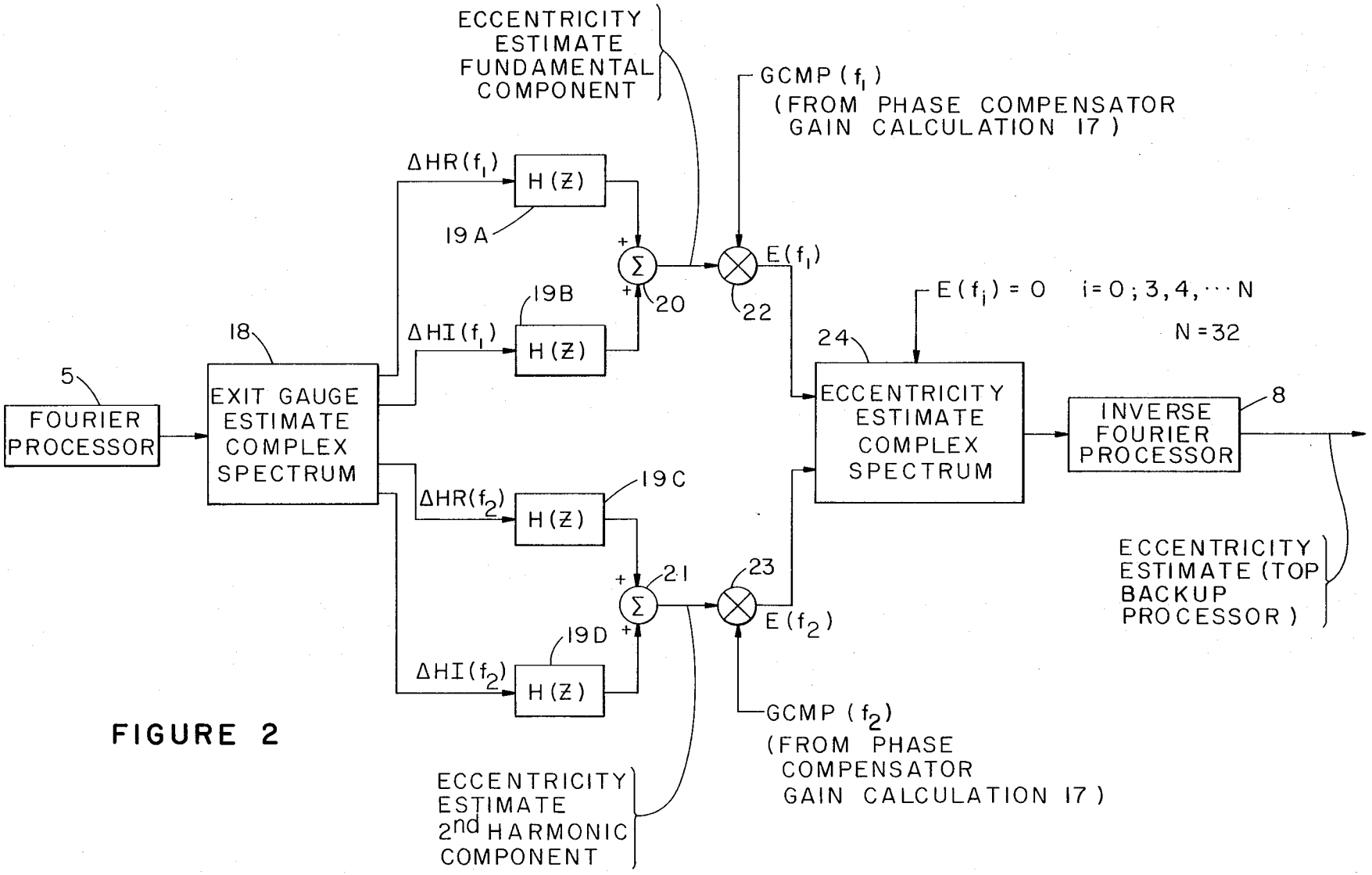

The invention, along with its objectives and advantages, will be best understood from consideration of the following detailed specification and the accompanying drawings in which:

FIG. 1 thereof is a schematic diagram showing the control algorithm disclosed in U.S. Pat. No. 4,222,254 to King et al corrected for phase delay, as provided by the present invention, and FIG. 2 is a schematic diagram showing details of the correction provided by the present invention.

PREFERRED EMBODIMENT

Referring now to the drawings, FIG. 1 thereof shows diagrammatically the process or algorithm of the above U.S. patent to King et al for controlling the results of eccentricity in a backup roll of a rolling mill (not shown), but modified in accordance with the present invention to compensate for delay in the responses of load cells and actuator means of a rolling mill. In FIG. 1, the rectangles made with solid lines indicate the processes of the King et al patent, while the boxes comprised of dash lines indicate the processes of the present invention. In addition, two such arrangements are required, one for each backup roll assembly of a rolling mill. The arrangements are identical, however, so that only one is shown in the figures of the drawings.

As disclosed in the patent, the gauge of material exiting the mill is continuously estimated using the standard gaugemeter equation augmented with the eccentricity estimate:

$$\Delta h = (\Delta F/M) + \Delta S + E \qquad (1)$$

where

- $\Delta h$ is a change in exit gauge,
- $\Delta F$ is a change in total rolling force or pressure,
- $\Delta S$ is a change in the position of the screws or hydraulic cylinders of a rolling mill,
- M is the modulus of elasticity of the mill, and
- E is the estimate of the eccentricity of the roll assemblies of the mill.

The estimate of backup roll eccentricity is continuously calculated using a Fourier processor and update algorithm for each backup roll.

More particularly, in FIG. 1 of the drawings, the output signal of the load cells 1 of a mill stand (not shown) is operated on by the modulus of elasticity M of the mill, at box 2, to compute the "stretch" $\Delta F/M$ of the mill housing. The exit gauge estimate $\Delta h$ is calculated by employing equation (1) at summing junction 3 where the housing "stretch" $\Delta F/M$, the measured actuator position ΔS (from an actuator and actuator controller 12), and the eccentricity estimate E (from an actuator dynamics circuit 13) are combined in the manner disclosed in the above patent to King et al. The eccentricity estimate E applied at junction 3 is used to remove the eccentricity component from the measured actuator position signal ΔS. The signal ΔS contains position changes from both eccentricity correction and an exit gauge control 12A. Once the eccentricity component is removed by subtracting E, the remaining position component can be summed with the "stretch" term ΔF/M to obtain an estimate of exit gauge change Δh due to gauge variations of the incoming strip. So that the subtraction of the position signal ΔS and eccentricity estimate E cancel the eccentricity component, the amplitude and phase of the eccentricity estimate provided by a junction 10 is adjusted by a model of the actuator dynamics 13 in such a manner that it matches the changes in these parameters caused by the actuator 12.

The operations of computing mill stretch (box 2), processing the eccentricity estimate E through a model of the actuator dynamics (box 13), and computing the estimated exit gauge Δh (summing junction 3) are performed by electronic circuits processing analog signals. All of the other indicated processing operations indicated in FIGS. 1 and 2 are performed by means of a digital computer (not otherwise depicted in the drawings).

As further described in the patent, each backup roll is fitted with a pulse encoder that generates a series of pulses (see 14 in FIG. 1), each pulse corresponding to a position increment of the roll's revolution. Upon receiving each pulse, a sample is taken of the estimated gauge Δh and stored in the input buffer 4 of the digital computer. This process continues for every pulse received until one complete backup roll revolution has occurred. (The typical count for the buffer 4 may be 64 points, each representing the estimated exit gauge variation Δh corresponding to a particular position in the revolution of the backup roll.) At this time the data stored in the input buffer 4 is directed to a Fourier processor 5 (of the computer) which transforms the data from a revolution-based signal to a set of complex numbers representing separate and distinct frequencies, i.e., fundamental and harmonic frequencies.

As described in the patent, the amplitudes of the fundamental and/or harmonics of the exit gauge estimate Δh are employed to generate a frequency representation of the roll eccentricity by use of an update algorithm 6. The details of the update algorithm 6 need not be discussed here as they are fully described in the U.S. patent to King et al. By means of an inverse Fourier transform, the output of 6 is changed back to a revolution-based signal and applied to the mill actuators 12.

For relatively low speeds of sheet travel, e.g., below 2,000 fpm and relatively low speed rotation of backup rolls, below about three Hz, the update algorithm of 6 is sufficiently accurate in providing outputs that function to offset the effects of roll eccentricity in the exit gauge of the sheet rolled. However, as indicated earlier at speeds above 2,000 fpm, mill actuators and load cells cannot respond rapidly at the frequencies associated with the force changes on the sheet due to roll eccentricity and thus introduce phase lag into the system.

It is due to this phase lag that any command signal generated for controlling the effects of eccentricity will incorporate phase errors in the resulting position changes that occur. In situations where the phase error becomes large, usually at high mill speeds, the resultant effect is that the system is forced to operate in an unstable condition such that the movements of the actuators no longer act to offset the effects of the roll eccentricity. During operation in this condition, the mill will produce a sheet product having large, undesired variations in its gauge. The bandwidth or maximum deviation away from the desired thickness may actually be increased over that of a mill having no gauge control system.

For this reason, the present invention provides phase compensation at 7 in FIG. 1 before the output of 6 is directed to an inverse Fourier processor 8. As discussed in the above patent, 8 returns the frequency components of the eccentricity estimate to signals based on time revolutions of the mill backup rolls. The output of 8 is then stored in the output buffer 9 of the computer. The data stored in this buffer is directed sequentially to summing junction 10 on the occurrence of each pulse received from a backup roll encoder signal (14).

The series of values from buffer 9 correspond to the eccentricity of the top backup roll while those from the bottom backup roll output buffer, as indicated by box 9A, correspond to the bottom backup roll eccentricity. Summing junction 10 adds the values received from each of the output buffers to form the total eccentricity estimate E. The command signal, employed to adjust the position of actuators 12, is then formed by inverting, as indicated by box 11, the output from 10 and summing it at junction 12B with the signal from the exit gauge control 12A. By this means, the actuator's position is regulated in an equal but opposite direction, as the estimated eccentricity, which results in the cancellation of the eccentricity effects on the material.

Broadly, the compensation provided at 7 is effected by first calculating the rotational velocity of the top backup roll at 14A. This can be accomplished by the roll encoders discussed in the King et al patent or any other suitable device for measuring speed, such as a tachometer mechanically associated with each of the rolls. Such encoders or tachometers produce pulses, as indicated by numeral 14 in FIG. 1, that are directed to a velocity calculating means 14A. The outputs of 14A are the fundamental and harmonic frequencies of the backup roll eccentricity disturbance, as computed from the backup roll velocity measurement. Again, these functions are identical for both backup rolls such that only one arrangement of the functions is shown.

Models of the dynamic responses of the mill actuators and load cells are developed and stored as equations representing their responses at 15 and 16. With the frequency calculations made at 14A, and the equations of the responses provided at 15 and 16, a calculation is made at a buffer 18 (FIG. 2) that indicates the precise error (signal amplitude and phase change) introduced into the system at each of the eccentricity frequencies, fundamental and harmonic, by the dynamic response of the actuators and load cells. The models of the dynamic responses include both "dead time", i.e., the time it takes for actuators and load cells to begin responding (when they receive an indication of a load change due to roll eccentricity) and the duration of response after they begin responding. Having this data available at 15 and 16 permits a phase compensator gain calculation 17 (FIG. 1), as explained in detail below. The compensator gain calculated at 17 is then used (in FIG. 2) to provide phase (and amplitude) correction of the signal at 8 so that the command signal generated to drive actuator 12 will cause its position changes to offset the effects of the roll eccentricity.

The equation employed to model the response of the actuators 12 is given by:

$$HCR(f_n) = \frac{[A_1A_2 + jA_12\pi f_n]\,[\cos(2\pi f_nT_D) - j\sin(2\pi f_nT_D)]}{[(A_5 - A_3(2\pi f_n)^2) + j(A_42\pi f_n)]} \quad (2)$$

with $HCR(f_n)$ being a complex number that represents the amplitude and phase response of the hydraulic cylinders at frequency $f_n$, $f_n$ being the frequency value of one of the components (fundamental or harmonic) of the eccentricity disturbance calculated by 14A, j being the complex operator equal to $\sqrt{-1}$, $A_i$, $i=1,2, \ldots 5$ being stored coefficients of the hydraulic cylinder response model, $T_D$ being the cylinder response time delay.

Similarly, the model of the response of the load cell/mill stack force measurement system 16 is given by:

$$HLC(f_n) = \frac{Kp[C_1C_2 + jC_12\pi f_n]\,[\cos(2\pi f_nT_D) - j\sin(2\pi f_nT_D)]}{[(C_5 - C_3(2\pi f_n)^2) + j(C_42\pi f_n)]} \quad (3)$$

with $HLC(f_n)$ being a complex number that represents the amplitude and phase response of the load cells at frequency $f_n$, $K_p$ being the gain of the rolling process, $C_i$, $i=1,2, \ldots 5$ being stored coefficients of the load cell response model, $T_D$ being the load cell response time delay.

After the magnitude and phase responses of the actuator mechanisms and load cell measurement devices have been evaluated for the fundamental $f_1$ and first harmonic frequency $f_2$ of the eccentricity disturbance, the phase compensator gains are calculated at 17 (FIG. 1) by use of the following equation:

$$GCMP(f_n) = \frac{1.0}{HLC(f_n)HCR(f_n)} \quad (4)$$

with $GCMP(f_n)$ being a complex number that represents the phase compensation at frequency $f_n$, corresponding to the fundamental or one of the harmonic components of the eccentricity process.

Details of the phase correction at 7 of the estimate of the eccentricity, output from the update algorithm 6, are diagrammatically indicated in FIG. 2 of the drawings. As previously discussed, the output of the Fourier processor 5 is the complex spectrum of the estimated exit gauge $\Delta h$. This signal is stored in the buffer denoted by 18 in FIG. 2. As disclosed in the U.S. patent to King et al, the fundamental and first harmonic frequencies of the exit gauge estimate are selected for further processing to provide the eccentricity estimate. However, other frequencies (harmonic) can be employed without departing from the spirit and scope of the invention.

The fundamental and second harmonic of buffer 18 are next separated into real and imaginary components by 18; $\Delta HR(f_1)$, $\Delta HI(f_1)$ in FIG. 2 are the real and imaginary components of the fundamental and $\Delta HR(f_2)$, $\Delta HI(f_2)$ are the real and imaginary components of the second harmonic. Each component is then individually operated on by an update function H(z) at 19A, 19B, 19C, 19D. This is the update function described in the above patent; it is employed in updating and converging the gauge estimates of the Fourier processor 5 into the eccentricity estimates.

The output of the update functions 19A, 19B are combined at summing junction 20 to form a complex number representing the fundamental component of the eccentricity estimate. The same process is employed at 21 to produce the second harmonic component of the eccentricity estimate. These estimates still contain the phase delay caused by the lag in the response of the load cells and moreover have not been adjusted for the phase error that will be inserted when the actuator command signal is transformed into actuator position change. This latter phase error is attributed to the lag in the response of the actuator mechanism.

Compensation for the phase error is effected at 22 in FIG. 2 for the fundamental frequency and at 23 for the first harmonic. For the fundamental frequency, this involves complex multiplication of the output of summing junction 20 with the phase compensator gain $GCMP(f_1)$ to form the phase corrected component $E(f_1)$ of the eccentricity estimate. A second complex multiplication occurs between the output of summing junction 21 and the compensator gain $GCMP(f_2)$ to form component $E(f_2)$. The phase compensator gains are provided from 17 of FIG. 1 and are developed in a manner described earlier.

The complex values $E(f_1)$ and $E(f_2)$ are stored in a buffer 24. The first, $E(f_0)$, and all other components, starting with $E(f_3)$, are then set to zero to produce, along with the fundamental and second harmonic components, the complex spectrum of the eccentricity estimate.

The complex spectrum of 24, now compensated for phase error, is converted back to a revolution-based signal by the inverse Fourier transform 8 and stored in the buffer unit of 9 (FIG. 1). Upon receiving a pulse from the backup roll encoder signal 14, a data point from this buffer is summed with one from the corresponding buffer for the bottom backup roll system 9A to produce one point of the total eccentricity estimate E. A sequence of such points, one for each occurring pulse 14, is inverted to form the command signal that orders responses of the mill actuators 12, the timing of the response now being corrected so that this control scheme remains stable and any eccentricity in the backup rolls is properly offset to provide a rolled product that has an even, consistent gauge.

While the invention has been described in terms of preferred embodiments, the claim appended hereto is intended to encompass all embodiments which fall within the spirit of the invention.

What is claimed is:

1. A method of controlling a rolling mill in which a gauge measuring and control system is employed to offset the effects of eccentricity of one or more of the rolls of a mill stand, and of increasing the range of mill speeds over which the gauge control system can maintain stable operation, the method comprising the steps of:

storing models of (1) the dynamic response of force transducers that measure the force at which the rolls engage material in the mill, and (2) the position response of actuator mechanisms of the mill that provide the force, measuring fundamental and harmonic frequencies of any eccentricity of the rolls during rotation thereof, estimating roll eccentricity at the measured frequencies, utilizing said frequencies and stored models of force transducer and actuator position responses to determine any amplitude changes and phase shifts occurring in measured force and in signals that control the acuator mechanisms due to the lag in responses of the force transducers and actuator mechanisms at these frequencies, combining the amplitude changes and phase shifts of the previous step to provide a set of gains that compensate for phase errors caused by the amplitude changes and phase shifts, applying these gains to the eccentricity estimate to provide an eccentricity estimate corrected for said amplitude and phase errors, and utilizing said corrected eccentricity estimate to offset the effects of roll eccentricity on the gauge of material exiting the mill by ordering appropriate changes in the position of the actuator mechanisms.

* * * * *